US007327092B2

(12) United States Patent
Caiafa et al.

(10) Patent No.: US 7,327,092 B2
(45) Date of Patent: Feb. 5, 2008

(54) CURRENT DRIVING CIRCUIT FOR INDUCTIVE LOADS

(75) Inventors: Antonio Caiafa, Niskayuna, NY (US); Juan Antonio Sabate, Saratoga Springs, NY (US)

(73) Assignee: GE Homeland Protection, Inc., Newark, CA (US)

( * ) Notice: Subject to any disclaimer, the term of this patent is extended or adjusted under 35 U.S.C. 154(b) by 93 days.

(21) Appl. No.: 11/290,670

(22) Filed: Nov. 30, 2005

(65) Prior Publication Data

US 2007/0120498 A1 May 31, 2007

(51) Int. Cl.
*H05B 37/00* (2006.01)

(52) U.S. Cl. ..... 315/174; 315/175; 315/160; 315/247; 315/291

(58) Field of Classification Search ..... 315/174, 315/175, 160, 291, 307, 247, 246, 209 R, 315/224, 225, 397
See application file for complete search history.

(56) References Cited

U.S. PATENT DOCUMENTS 5,932,976 A * 8/1999 Maheshwari et al. ..... 315/291

OTHER PUBLICATIONS

U.S. Appl. No. 11/048,158 entitled System for Forming X-Rays and Method for Using Same, William Huber et al.

U.S. Appl. No. 11/048,159 entitled System for Forming X-Rays and Method for Using Same, William Huber et al.

* cited by examiner

*Primary Examiner*—Tuyet Vo
(74) *Attorney, Agent, or Firm*—William E. Powell, III; Curtis B. Brueske

(57) ABSTRACT

A circuit for driving the current for inductive loads such as an electron beam deflection coil for an x-ray generator system. The circuit includes two selectable voltage levels provided by a high level and a low level source. A plurality of switches selects the voltage level and determines the polarity of the current through the coil. The high level source is selected when the load is charging or discharging. The low level source is selected when the load is operating in a constant current mode, where a high frequency switching device controls the voltage through the load by switching the low level source to generate a PWM waveform according to a reference current duty cycle. A feedback loop monitors the current through the load to adjust the duty cycle of the PWM waveform to more accurately control the current through the load.

11 Claims, 5 Drawing Sheets

CURRENT DRIVING CIRCUIT FOR INDUCTIVE LOADS

STATEMENT REGARDING FEDERALLY SPONSORED RESEARCH & DEVELOPMENT

This invention was made with Government support under contract number HSTS04-04-G-RED940 awarded by The Transportation Security Administration. The Government has certain rights in the invention.

BACKGROUND

The invention relates generally to circuits for driving large inductive loads. More specifically, the invention relates to a current driver capable of producing fast charges and discharges of an inductor.

X-ray scanning is a popular method for use in a variety of everyday applications, including medical diagnostics, industrial imaging, and security systems. Commercially available x-ray sources typically utilize conventional thermionic emitters, which are helical coils made of conductive wire and operated at high temperatures. Each thermionic emitter is configured to emit a beam of electrons to a single focal spot on a target. To obtain a total current of 10 to 20 mA with an electron beam size of 10 $mm^2$, helical coils formed of a metallic wire having a work function of 4.5 eV must be heated to about 2600K. Tungsten wire is a popular choice for forming the helical coil due to its robust nature.

Alternative devices are also used for providing an x-ray source for an x-ray scanning system. For example, such devices are described in co-owned, co-pending U.S. application Ser. Nos. 11/048,158 and 11/048,159, both filed Feb. 1, 2005. Common to the different x-ray sources is that these sources represent large inductive loads that are operated by a current. The current for the x-ray sources or inductors is driven by circuits that are meant to charge and discharge the inductor quickly while still providing accurate current levels. However, due in part to the number of switches these driving circuits typically require, these driving circuits can be expensive and often experience high losses. Furthermore, as the system operates in a charging/discharging mode and a steady state mode that each require different voltage levels, the number of power sources necessary for the system increases the expense of the system and limits the transition time between the operating modes. Additionally, during the steady state operation of the inductive load, high ripple can occur due in part to the voltage levels.

It would therefore be desirable to have a deflection coil current driving circuit having a minimum number of switches and power sources to increase the transition time, reduce ripple, and reduce cost. Additionally, to assure accurate current levels through the inductive load, a pulse width Modulation scheme for the analog circuit is also desirable.

BRIEF DESCRIPTION

Briefly, one aspect of the invention is a current driver for an inductive load comprising a power generation system including a low level voltage source, a high level voltage source, a high frequency switching device coupled to the low level voltage source and the inductive load, through an full bridge for polarity selection, and at least one additional switching device coupling the coil to the high level voltage source. The current driver further includes a control system coupled to the power generation system, wherein the control system determines the duty cycle of a pulse width modulation waveform to be generated by the high frequency switching device. Further, the control system operates the additional switching device to select only one of the low level voltage source and the high level voltage source to power the coil.

Another aspect of the invention is a method for driving a electron beam deflection coil for an x-ray generation system with accurate current levels is provided. The method includes (i) providing a power converter circuit coupled to the deflection coils, wherein the power converter circuit comprises two selectable voltage levels and one external power supply, wherein a first voltage is less than a second voltage, wherein a high frequency switching device is coupled to the first voltage and the load through a full bridge, wherein a blocking switching device is coupled to the second voltage and the load through a full bridge, and wherein a blocking device couples the first and second voltage;

(ii) determining a pulse width modulation duty cycle based upon a reference current;

(iii) operating the blocking switching device and the full bridge, and opening the high frequency switching device to allow the second voltage to charge the coil;

(iv) opening the blocking switching device to prevent the second voltage from further charging the load;

(v) operating the high frequency switching device to produce a pulse width modulation waveform according to the duty cycle determined in step (ii); and (vi) operating the blocking switching device and the full bridge, and opening the high frequency switching device to discharge the coil.

DRAWINGS

These and other features, aspects, and advantages of the invention will become better understood when the following detailed description is read with reference to the accompanying drawings in which like characters represent like parts throughout the drawings, wherein.

DETAILED DESCRIPTION

As illustrated in the accompanying drawings and discussed in detail below, an exemplary embodiment of the invention is directed to a faster and more efficient. current driving circuit. Applications for embodiments of the invention are described above and below and include an x-ray scanning system for use in security and medical applications. It should be appreciated, however, that the embodiments of the invention are not limited to these applications.

Figure 1:
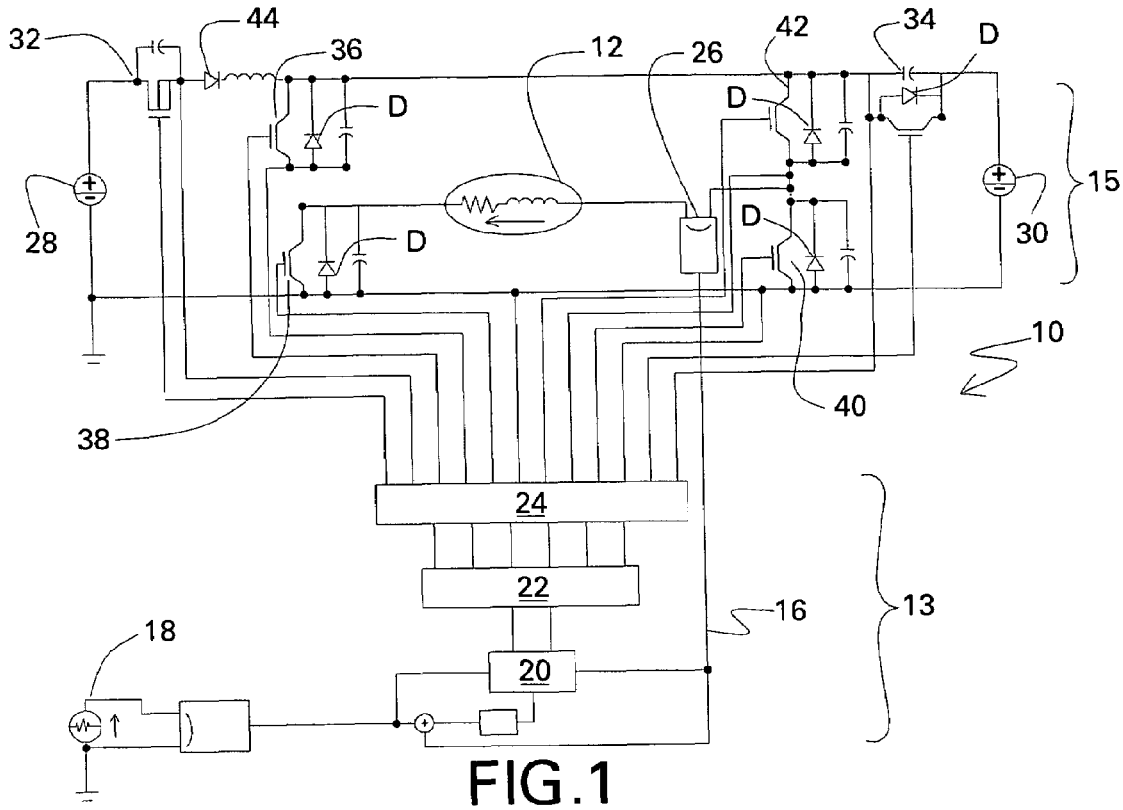
FIG. 1 is a circuit diagram showing the topology of an exemplary current driving circuit according to the invention.

FIG. 1 shows a circuit diagram of one exemplary embodiment of a current driving system 10 for driving an inductive load 12. Inductive load 12 may be any such load known in the art, but is preferably a helical coil for deflecting electron beams within an x-ray generator system. Current driving system 10 is configured to operate in two modes: a steady state or constant current mode for providing an accurate and constant current level to inductive load 12, and a ramping mode for either charging or discharging inductive load 12. To this end, current driving system 10 generally includes a low level voltage source 28 for operating inductive load 12 in the constant current mode, a high level voltage source 30 for operating inductive load 12 in the ramping mode, power converter circuitry 15 for providing current and switching between the two operating modes and to select the polarity of the deflection coil current, and control circuitry 13 for regulating the switches in power converter circuitry 15 and the current levels in inductive load 12.

Low level voltage source 28 and high level voltage source 30 are both external power sources in the embodiment shown in FIG. 1. The power sources selected may be any known in the art, such as off-the-shelf power supplies and batteries. The precise voltage levels depend upon the desired application; however, low level voltage source 28 should provide as low a voltage as practicable for the application. Current ripple in system 10 should be minimized, and the smaller the voltage from low level voltage source, the smaller the current ripple in system 10. The low level voltage provided by low level voltage source 28 should not be less than is required to offset the parasitic resistance of system 10. For example, a coil (12) with 0.4 Ohms resistance and 300 μH inductance, in a system (10) requiring a maximum current of 60 A and a current slew rate of 0.5 A/μsec, the low-voltage source (28) and the high voltage source (30) in one embodiment were 30V and 150V, respectively.

Figure 2:
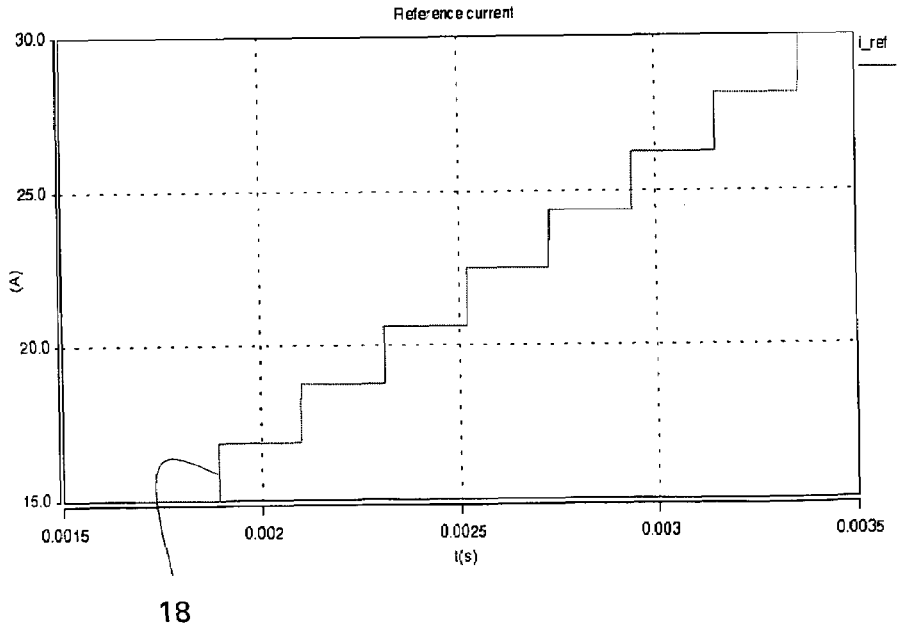
FIG. 2 is a graph of a typical reference current for use in the circuit of FIG. 1.

Control circuitry 13 generally includes a reference current 18, a controller 22, which includes a pulse width modulation (PWM) generator 20, and control logic for switch selection, a switch drive chip 24 and a current probe 26. Reference signal 18, corresponding to the desired coil current level, is generated in the controller using some type of digital to analog converter from the digital reference values provided to the controller from the x-ray system main control. A typical staircase signal waveform for use as reference current 18 is shown in FIG. 2.

Figure 1A:
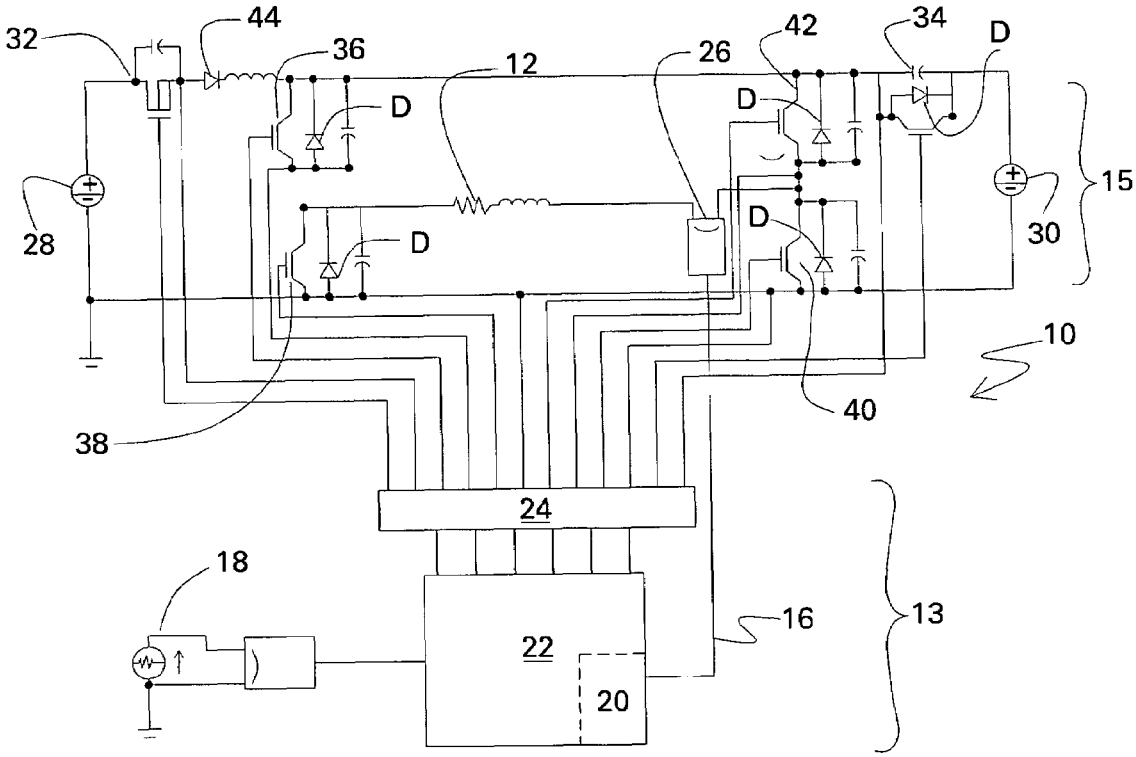
FIG. 1A is a circuit diagram showing the topology of an alternate exemplary driving circuit according to the invention.

A PWM scheme is used to regulate the voltage applied to the inductive load 12 from low value voltage source 28 so that the current through inductive load 12 matches reference signal 18 during constant current mode. Preferably, PWM signal generator 20 is electrically connected to an additional power source 21. Also, PWM signal generator 20 may be embedded within the controller 22, as shown in FIG. 1A. Such an embedded configuration is suitable for use with any of the circuit topologies shown or described herein.

Reference signal 18 is electrically connected to PWM generator 20, preferably a master chip connected to reference current 18 by one or more electrical leads. PWM generator 20 includes clock circuitry and processing elements to determine the PWM voltage duty cycle to drive a current through the coil that matches the desired reference signal 18. Preferably, reference current 18 is a signal or pattern pre-programmed into controller 22 or generated by a separate computer or chip connected to controller 22.

PWM generator 20 is electrically connected to controller 22 or PWM generator 20 is embedded in the controller 22, as shown in FIG. 1A. Controller 22 is, in turn, electrically connected to switch drive chip 24. Controller 22 is a processor that determines when to operate system 10 in charging mode, discharging mode, or constant current mode. Controller 22 monitors the current through inductive load 12. When system 10 is in ramping mode, the current through inductive load 12 is provided by high level voltage source 30 and varies as inductive load 12 charges or discharges. During the charge or discharge mode, the device 44 provides blocking capability and prevents the current from flowing from the high voltage to the low voltage source. When the current through inductive load 12 reaches a threshold level while charging inductive load 12, i.e., increasing the current absolute value, controller 22 changes the operation of system 10 to constant current mode, when the current is provided by low level voltage source 28 and the device 44 is in conduction mode. To do so, controller 22 sends a signal to switch drive chip 24 to activate or deactivate switches within power converter circuitry 15.

The mode of operation of system 10 is determined by the condition of at least one switch in power converter circuitry 15. Preferably, five voltage source switches, first switch 34, second switch 36, third switch 38, fourth switch 40, and fifth switch 42, are used. Switches 34, 38, 40, 42 form a full bridge defining current polarity across load 12. Preferably, the number of switches is minimized to reduce costs and parasitic resistance. Voltage source switches 34, 36, 38, 40, 42 may be any type of switching devices known in the art, but are preferably IGBT switches. Voltage source switches 34, 36, 38, 40, 42 are activated in groups to define current paths for only one voltage source 28, 30 at any given instant in time.

When low level voltage source 28 is providing current to control inductive load 12 using the PWM control scheme, a high frequency switching device 32 is operated to generate the PWM waveform to be applied to inductive load 12. High frequency switching device 32 may be any switching device known in the art, but is preferably a MOSFET switch. The PWM waveform generated by high frequency switching device 32 is a square wave having the duty cycle previously determined by PWM generator 20. Switch drive chip 24 modulates high frequency switching device 32 according to the duty cycle from PWM generator 20 via controller 22. While high frequency switching device 32 is actively modulating, none of the other switches in system 10, alters its state.

Figure 3:
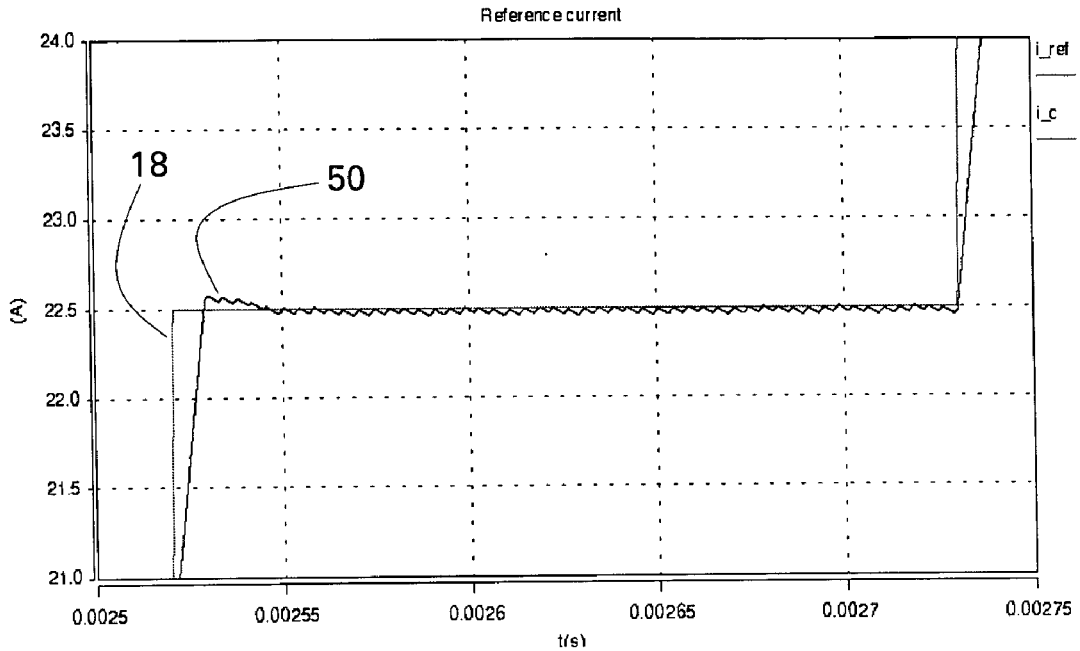
FIG. 3 is a graph of a portion of the reference current of FIG. 2 and simulation results showing the current generated by the circuit of FIG. 1.

Additionally, in order to assure the accuracy of the current of inductive load 12, a current probe 26 is positioned at or near the current output for inductive load 12. As current passes through current probe 26 from inductive load 12, current probe 26 reads the current level and transmits a signal back to the controller 22, therefore to the PWM generator, via an electrical lead 16. If the input current is too low or too high, PWM generator adjusts the square wave duty cycle accordingly. In turn, the switching or modulation rate of high frequency switching device 32 is altered to match the new duty cycle. This closed-loop control mechanism allows for extremely accurate control of the current in inductive load 12. While the PWM operates at high switching frequency, the feedback loop operates at a much lower frequency. As a consequence there is no need of a large bandwidth current sensor 26. FIG. 3 shows a graph of a generated current 50 produced by system 10 to mirror reference current 18. In this example, system 10 includes an 800 μH coil as inductive load 12 with 0.4 Ohms of parasitic resistance in the circuits. However, the parasitic resistance may be any known in the art, typically ranging from about 0.1 Ohms to about 7 Ohms. FIG. 3 shows generated current 50 overlaid with a portion of the graph of reference current 18 as shown FIG. 2 to clearly demonstrate the accuracy of system 10 in controlling the current levels through inductive load 12.

Table 1 below shows which switches are closed to provide appropriate circuit paths during the operation of system 10. The arrow in FIG. 1 indicates the direction of positive current. If a switch is not specifically listed as closed, then it is assumed to be interrupting the circuit.

TABLE 1

Switch Groupings for Voltage Source-Specific Current Paths

| Controlling Voltage Source | Description | Current direction | Closed switches | High Frequency Switch 32 Modulating |
|---|---|---|---|---|
| High Level 30 | Charge mode | Negative | 36, 40, 34 | No |
| Low Level 28 | Constant Current Mode | Negative | 36, 40 | Yes |
| High Level 30 | Discharge mode | Negative | NONE | No |
| High Level 30 | Charge mode | Positive | 38, 42, 34 | No |
| Low Level 28 | Constant Current Mode | Positive | 38, 42 | Yes |
| High Level 30 | Discharge Mode | Positive | NONE | No |
| None | Neutral | Zero | 38, 40 | No |

Figure 4:
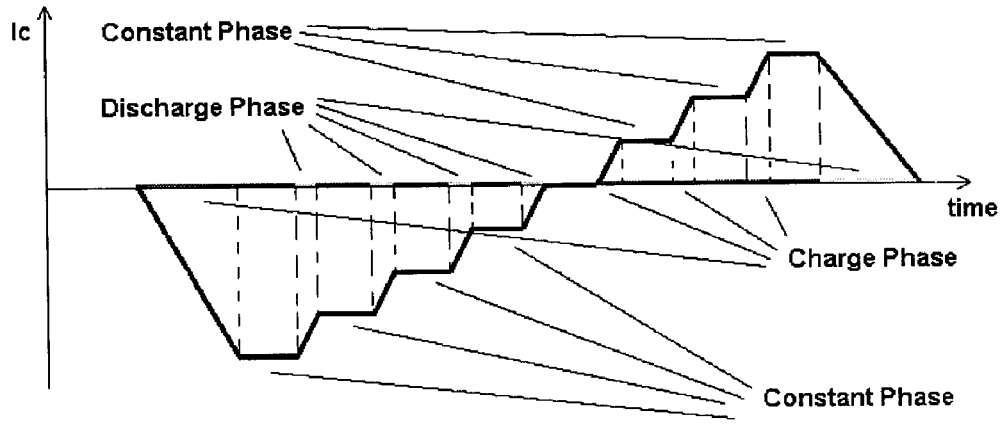
FIG. 4 is a graph showing a generic waveform depicting the operation cycle of the circuit of FIG. 1.

FIG. 4 shows a generic current waveform reflecting the operations noted in Table 1. When high frequency switch 32 is modulating while the current direction is negative and is in an open position, the current flow through second switch 36 and fourth switch 40, as well as diodes D in anti-parallel to third switch 38 and fifth switch 42. Similarly, when high frequency switch 32 is modulating while the current direction is positive and is in an open position, the current flow through third switch 38 and fifth switch 42, as well as the diodes D in anti-parallel to second switch 36 and fourth switch 40. Preferably, diodes D are silicon carbide diodes, although any diodes known in the art are suitable for use in system 10.

Further, while system 10 is in discharge mode while the current direction is negative, the current flows through diodes D in anti-parallel to first switch 34, third switch 38, and fifth switch 42. Similarly, while system 10 is in discharge mode while the current direction is positive, the current flows through diodes D in anti-parallel to first switch 34, second switch 36, and fourth switch 42.

Figure 5:
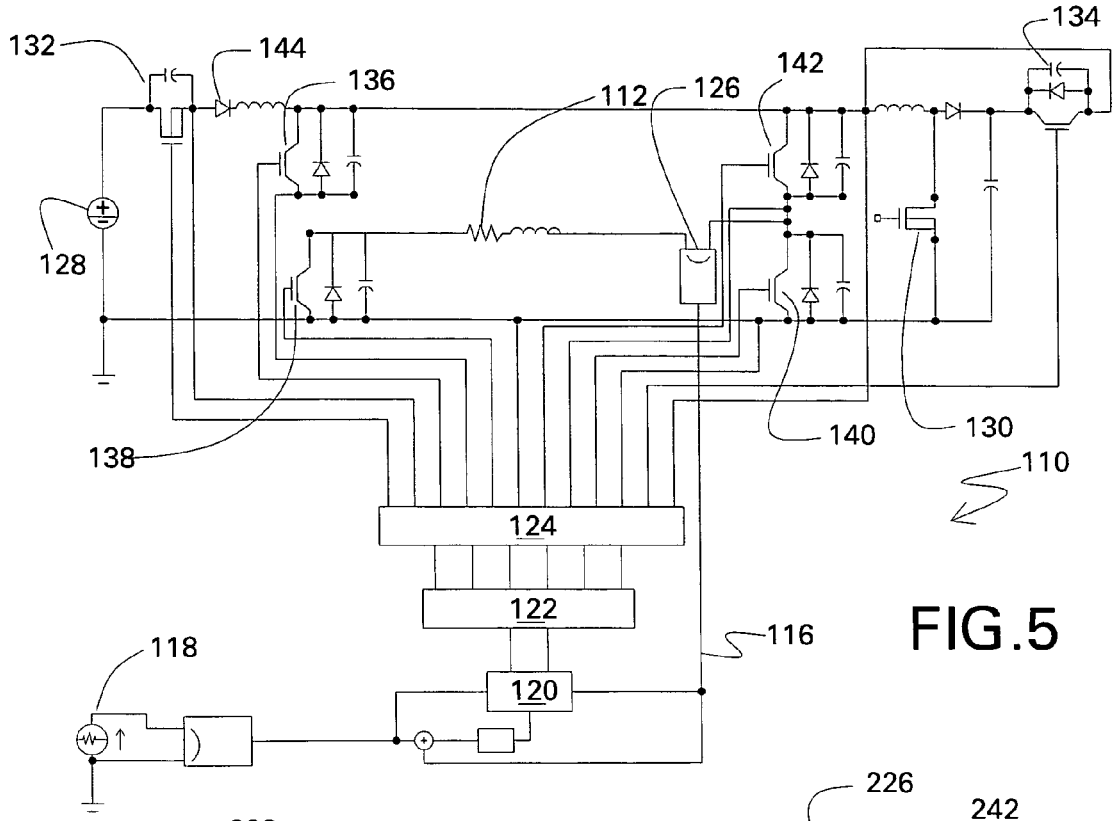
FIG. 5 is a circuit diagram showing the topology of another exemplary embodiment of the current driving circuit according to the invention.

FIG. 5 shows an alternate topology for a system 110 according to the invention. System 110 is generally the same as system 10 described and shown above with respect to FIG. 1, except that system 110 includes only one external power source, low level voltage source 128. High level voltage source 30 has been replaced with circuitry-based high level voltage source 130. High level voltage source 130 is a DC-DC voltage converter, and it may be any such converter capable of boosting the voltage the desired amount. For example, as shown in FIG. 5, high level voltage source 130 is a boost converter. Alternate DC-DC converters suitable for use in system 110 include but are not limited to a buck-boost converter, a Buck converter, a CUK converter, a flyback converter, a non-inverting buck-boost converter, and a forward converter.

System 110 operates essentially in the same manner as system 10 to produce accurate current levels to an inductive load 112 except that low level voltage source 128 always powers system 110. As the current provided by low level voltage source 128 crosses high level voltage source 130, the voltage is raised to the desired high level voltage level.

Figure 6:
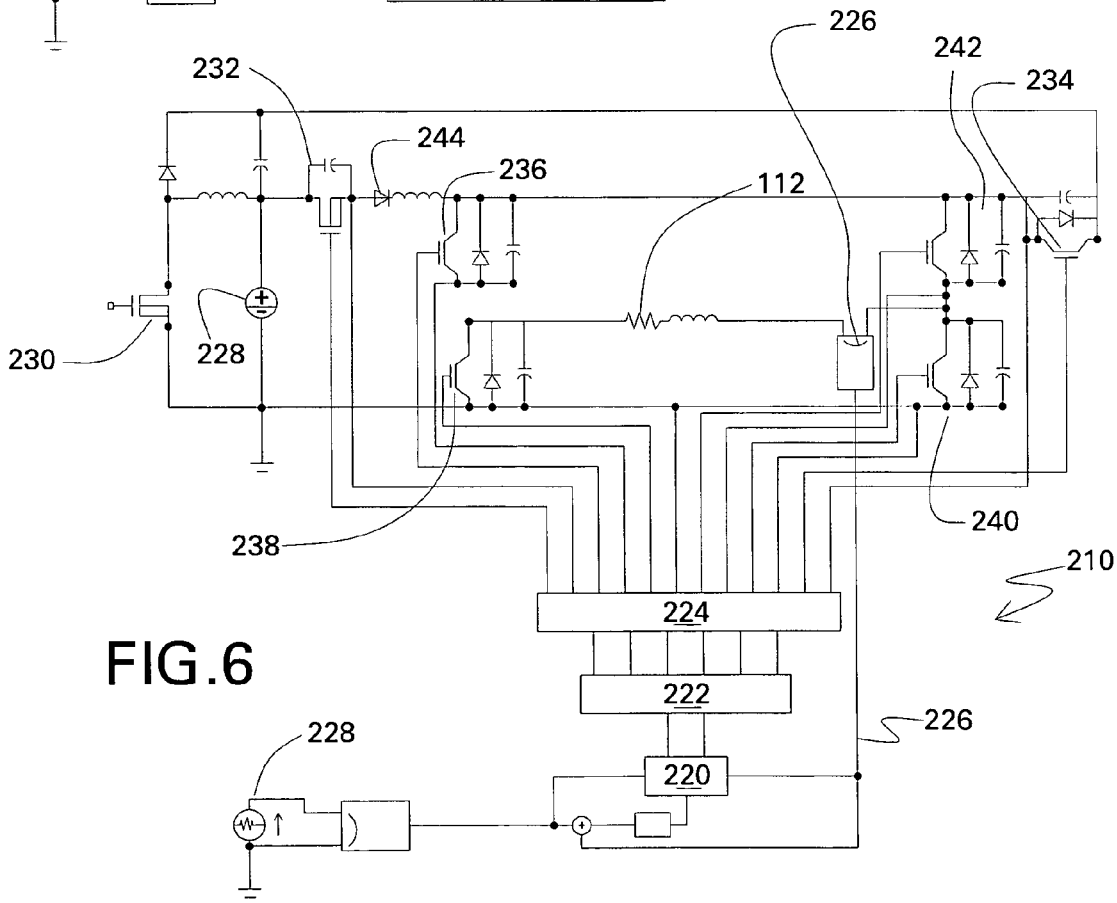
FIG. 6 is a circuit diagram showing the topology of another exemplary embodiment of the current driving circuit according to the invention.
Figure 7:
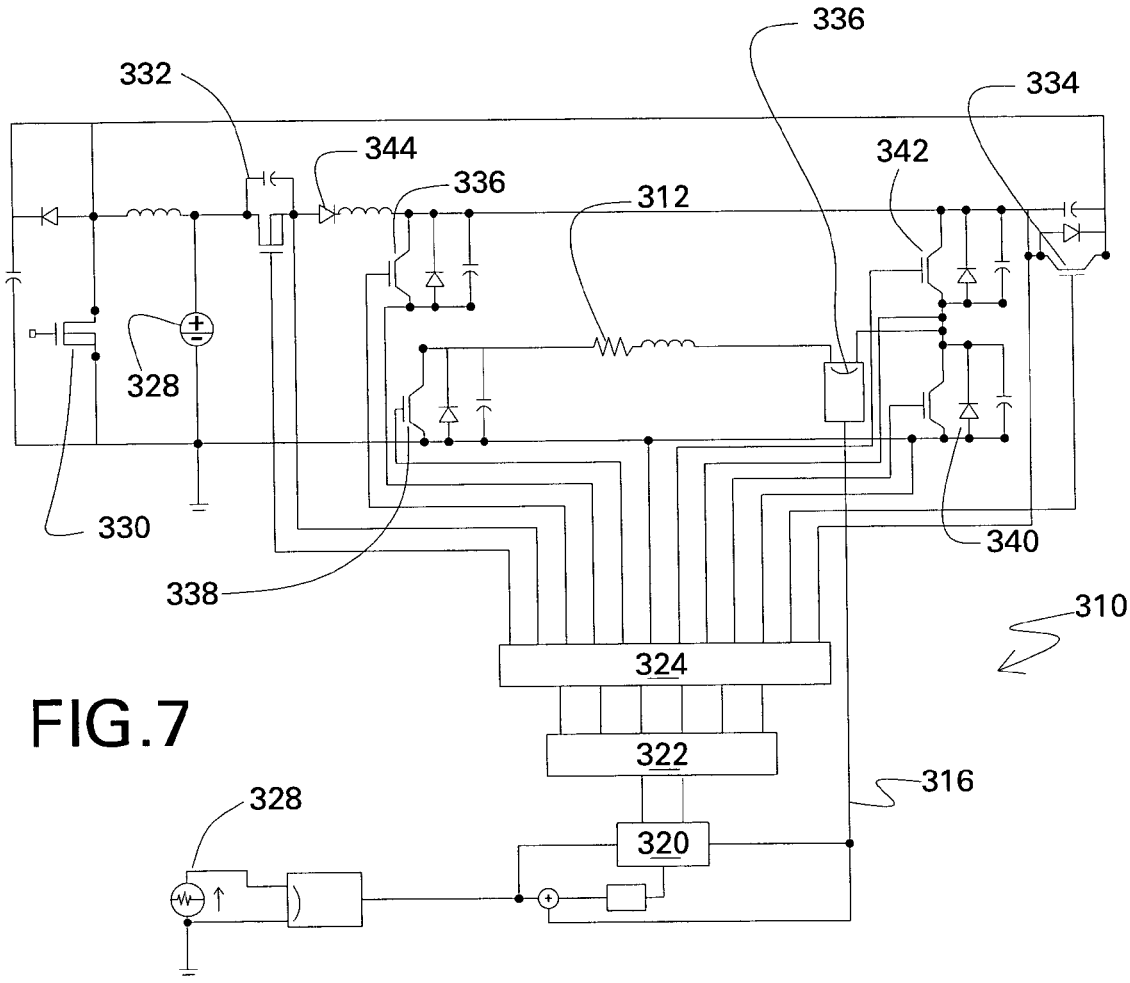
FIG. 7 is a circuit diagram showing the topology of yet another exemplary embodiment of the current driving circuit according to the invention.

FIG. 6 shows another topology for a system 210 according to an embodiment of the invention. Similar to system 110 as shown in FIG. 5, system 210 uses only one external power source, namely a low level voltage source 228. A high level voltage source 230, a DC-DC converter similar to the DC-DC converter shown and described above as high level voltage source 130 in system 110 (shown in FIG. 5) is also included with system 210. However, in system 210, high level voltage source 230 is placed in series with low level voltage source 228. Also, as shown in FIG. 7, another topology for a system 310 according to an embodiment of the invention is similar to those shown in FIGS. 5 and 6. However, in system 310, the DC-DC converter that acts as a high level voltage source 330 is connected directly to ground. This arrangement should provide a better noise protection. System 110 shown in FIG. 5 may be susceptible to noise created by the operation of device 132, while systems 210 and 310 shown in FIGS. 6 and 7, respectively, are virtually immune to any noise operation introduced by the operation of devices 232, 332.

The invention as described above provides many advantages. By using a high level of voltage in the ramping mode and a smaller voltage during the constant current mode, ripple is lessened while the speed of transition is enhanced. The current level of the inductive load (12) is highly accurate due to the combination of the feedback loop and the feed-forward PWM control. Also, because the total number of switches (36, 38, 40, 42) in series with the inductive load (12) is minimal, the system losses are low. Similarly, due to the minimal number of switches (32, 34, 36, 38, 40, 42), the use of only one or two external power sources (28, 30), and the use of low bandwidth current sensor (26), costs are kept low.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A current driver for an electron beam deflection coil for an x-ray generation system comprising:

two selectable voltage levels;

a blocking switching device coupled to the selectable voltage levels for selecting one of the two voltage levels;

a full bridge disposed between the voltage levels and the electron beam deflection coil;

a feed-forward loop for controlling the PWM duty cycle of the voltage across the electron beam deflection coil; and a feedback loop for controlling the accuracy of the current level through the electron beam deflection coil.

2. The current driver of claim 1, wherein the feed-forward loop comprises a reference current, a pulse width modulation generator for determining a duty cycle according to the reference current, a high speed switching device connected to the low level voltage source for generating a pulse width modulation waveform according to the duty cycle, and a blocking device that prevents the current from flowing from the high voltage to the low voltage level during charge or discharge mode.

3. The current driver of claim 1, wherein the feedback loop comprises a reference current, a pulse width modulation generator for determining a duty cycle according to the reference current, a high speed switching device connected to the low level voltage source for generating a pulse width modulation waveform according to the duty cycle, a current probe or sensor connected to the electron beam deflection coil and the pulse width modulation generator, wherein the current probe is configured to measure a current level through the electron beam deflection coil, and wherein the pulse width modulation generator is configured to adjust the duty cycle according to the current level through the electron beam deflection coil if the current level does not match an anticipated current level.

4. The current driver of claim 1 further comprising a high level voltage source and a low level voltage source for generating the two selectable voltage levels.

5. The current driver of claim 4, wherein the low level voltage source comprises an external power source.

6. The current driver of claim 5, wherein the high level voltage source comprises a DC-DC converter.

7. A method for driving an electron beam deflection coil with accurate current levels comprising the steps of:

(i) determining a pulse width modulation duty cycle based upon a reference current;

(ii) closing a blocking switching device to allow a high level voltage source to charge the coil;

(iii) opening the blocking switching device to prevent the high level voltage source from further charging the load;

(iv) operating a high frequency switching device to produce a pulse width modulation waveform from a low level voltage source according to the duty cycle determined in step (i); and (v) opening the blocking and high frequency switching devices to discharge the coil.

8. The method for driving an electron beam deflection coil of claim 7, wherein the reference current comprises a stepped profile.

9. The method for driving an electron beam deflection coil of claim 7, further comprising the steps of:

(vii) monitoring a current through the coil;

(viii) providing the value of the current through the coil to a controller; and (ix) adjusting the pulse width modulation duty cycle according to the current through the coil.

10. The method for driving an electron beam deflection coil of claim 9, wherein the controller operates the high frequency switching device.

11. The method for driving an electron beam deflection coil of claim 9, wherein the controller operates the blocking switching device.

* * * * *

UNITED STATES PATENT AND TRADEMARK OFFICE

CERTIFICATE OF CORRECTION

PATENT NO. : 7,327,092 B2
APPLICATION NO. : 11/290670
DATED : February 5, 2008
INVENTOR(S) : Caiafa et al.

It is certified that error appears in the above-identified patent and that said Letters Patent is hereby corrected as shown below:

On the Title Page, in item (75), under "Inventors", in Column 1, Line 2, delete "Ganesvoort," and insert -- Gansevoort, --, therefor.

On the Title Page, in the Figure, delete " 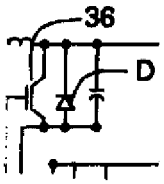 " and insert -- 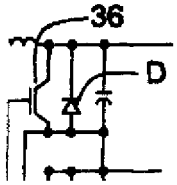 --, therefor.

In Fig. 1, Sheet 1 of 5, delete " 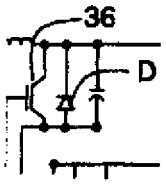 " and insert -- 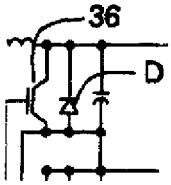 --, therefor.

In Fig. 1A, Sheet 2 of 5, delete " 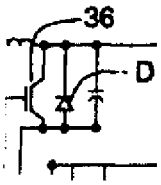 " and insert -- 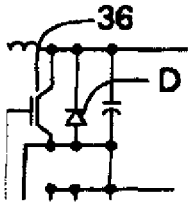 --, therefor.

In Fig. 5, Sheet 4 of 5, delete " 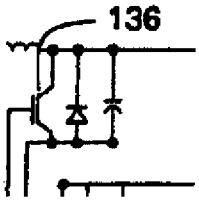 " and insert -- 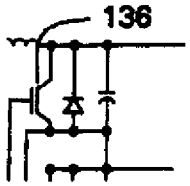 --, therefor.

In Fig. 6, Sheet 4 of 5, delete " 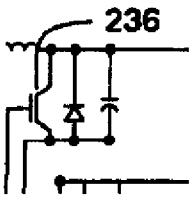 " and insert -- 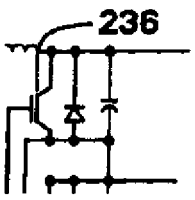 --, therefor.

In Fig. 7, Sheet 5 of 5, delete " 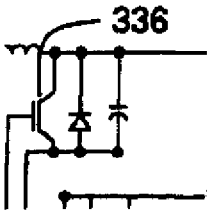

" and insert -- 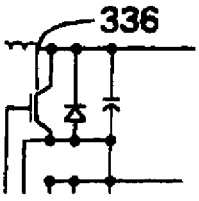

--, therefor.

In Fig. 7, Sheet 5 of 5, above Tag "342", delete "336" and insert -- 326 --, therefor.

Signed and Sealed this

Fifth Day of January, 2010

David J. Kappos

David J. Kappos
*Director of the United States Patent and Trademark Office*